US008511258B2

(12) United States Patent
Yamamoto et al.

(10) Patent No.: US 8,511,258 B2
(45) Date of Patent: Aug. 20, 2013

(54) COAL BOILER AND COAL BOILER COMBUSTION METHOD

(75) Inventors: Kenji Yamamoto, Hitachinaka (JP); Masato Handa, Mito (JP); Teruyuki Okazaki, Hitachiohta (JP); Kazumi Yasuda, Hitachi (JP); Osamu Ito, Hitachiohta (JP)

(73) Assignee: Hitachi, Ltd., Tokyo (JP)

( * ) Notice: Subject to any disclaimer, the term of this patent is extended or adjusted under 35 U.S.C. 154(b) by 1420 days.

(21) Appl. No.: 12/019,451

(22) Filed: Jan. 24, 2008

(65) Prior Publication Data

US 2008/0276844 A1 Nov. 13, 2008

(30) Foreign Application Priority Data

May 9, 2007 (JP) ..... 2007-124063

(51) Int. Cl.
*F22D 7/02* (2006.01)

(52) U.S. Cl.
USPC ..... 122/406.1; 122/468; 122/460; 110/204; 110/345

(58) Field of Classification Search
USPC ..... 122/450, 460, 467, 468, 488, 1 B, 122/406.1; 423/239.1; 110/204, 345, 210
See application file for complete search history.

(56) References Cited

U.S. PATENT DOCUMENTS

| | | | | |
|---|---|---|---|---|
| 2,161,110 | A * | 6/1939 | Tomlinson et al. | 423/207 |
| 3,298,360 | A * | 1/1967 | Rupprecht | 122/510 |
| 3,395,512 | A * | 8/1968 | Finney, Jr. et al. | 95/273 |
| 4,031,862 | A * | 6/1977 | Smith | 122/421 |
| 4,245,588 | A * | 1/1981 | Gill et al. | 122/6 A |
| 5,247,907 | A * | 9/1993 | Lee et al. | 122/1 R |
| 5,299,534 | A * | 4/1994 | Janka | 122/477 |
| 5,605,118 | A * | 2/1997 | Sinn et al. | 122/479.1 |
| 5,769,156 | A * | 6/1998 | Storbacka | 165/145 |
| 5,787,844 | A * | 8/1998 | Paju | 122/7 C |
| 5,803,020 | A * | 9/1998 | Palmgren | 122/7 R |
| 5,943,865 | A * | 8/1999 | Cohen | 60/653 |
| 6,360,680 | B1 * | 3/2002 | Breen et al. | 110/345 |
| 6,446,584 | B1 * | 9/2002 | Franke et al. | 122/460 |
| 7,434,543 | B2 * | 10/2008 | Raukola et al. | 122/7 R |
| 7,803,216 | B2 * | 9/2010 | Koyama et al. | 95/189 |
| 7,954,460 | B2 * | 6/2011 | Kimura et al. | 122/235.15 |
| 8,020,297 | B2 * | 9/2011 | Yoshino | 29/890.031 |

FOREIGN PATENT DOCUMENTS

| | | |
|---|---|---|
| JP | 63-243603 A | 10/1988 |
| JP | 10-232002 A | 9/1998 |
| JP | 2000-074311 A | 3/2000 |
| JP | 2002-081610 | 3/2002 |
| JP | 2003-3148805 | 11/2003 |
| JP | 3652988 | 3/2005 |

OTHER PUBLICATIONS

"Steam/ its generation and use" Babcock & Wilcox, 39th Edition, p. 13-2.

* cited by examiner

*Primary Examiner* — Gregory A Wilson
(74) *Attorney, Agent, or Firm* — Mattingly & Malur, PC

(57) ABSTRACT

Disclosed is a coal boiler that makes it possible to reduce the height of the boiler and shorten the period of construction. The coal boiler includes a first furnace in which a combustion gas generated by burning coal and air ascends; a second furnace in which the combustion gas supplied from the first furnace flows downward; and a heat recovery area in which the combustion gas supplied from the second furnace flows upward.

18 Claims, 18 Drawing Sheets

COAL BOILER AND COAL BOILER COMBUSTION METHOD

BACKGROUND OF THE INVENTION

1. Field of the Invention

The present invention relates to a coal boiler and to a coal boiler combustion method.

2. Description of the Related Art

Boilers burn fuel to generate heat and generate steam through the use of the generated heat. Further, the boilers use the generated steam to drive a steam turbine and generate electrical power. However, boilers generating an electrical power of 500 MW or more have a 50 m or taller furnace and require a long construction period. An inverted boiler described, for instance, in JP-A-2003-314805 (claims and FIG. 1) and a transverse boiler described, for instance, in Japanese Patent No. 3652988 were invented to solve the above-mentioned problem. When such an inverted boiler or transverse boiler was used, the flow of a combustion gas was directed downward or sideways, respectively.

As regards a small-size boiler, a three-pass boiler is disclosed in a nonpatent document entitled "Steam, Its Generation and Use" (Babcock & Wilcox, 39th Edition, page 13-2). This three-pass boiler operates so that a combustion gas ejected from a burner sequentially flows upward, downward, and upward, and is discharged to the outside.

Meanwhile, if unburned carbon and NOx discharged from a boiler are to be reduced, it is important that the combustion time be increased. Such being the case, it was necessary, as described in JP-A-2002-81610, to increase the height of a furnace of a two-pass boiler in which the combustion gas ejected from a burner sequentially flows upward and downward and is discharged to the outside.

SUMMARY OF THE INVENTION

In the boiler described in JP-A-2003-314805, the fuel and air ejected from a burner descend and burn. When temperature rises due to combustion, the flame ascends due to buoyancy. However, a high-concentration unburned gas descends while a low-concentration combustion gas ascends. As a result, the amount of unburned carbon increases, thereby making the roof gas temperature unduly high.

As regards the boiler described in Japanese Patent No. 3652988, a roof was difficult to design because the combustion gas flows transversely and a high-temperature gas gathers at the roof due to buoyancy. When combustion is taken into consideration, it is preferred that the flame ascend at the beginning of combustion as in the case of a two-pass boiler.

In a three-pass boiler in which a pendant heat exchanger is installed at a place where combustion gas ascends as described in the nonpatent document entitled "Steam, Its Generation and Use," a high-temperature gas, which has once ascended, flows into the heat exchanger. Such a high-temperature gas flow into the heat exchanger may shorten the useful life of the heat exchanger or block a flow path with ash. Therefore, it was necessary to maintain a low combustion gas temperature within a furnace. Thus, the two-pass boiler and three-pass boiler were not effectively used. In addition, NOx and unburned carbon increased in amount because fuel combustion terminated in a furnace in which a burner was installed.

An object of the present invention is to provide a coal boiler and coal boiler combustion method that make it possible to reduce the height of the boiler and shorten the period of construction.

The present invention includes a first furnace in which a combustion gas generated by burning coal and air ascends; a second furnace in which the combustion gas supplied from the first furnace flows downward; and a heat recovery area in which the combustion gas supplied from the second furnace flows upward.

The present invention provides a coal boiler and coal boiler combustion method that make it possible to reduce the height of the boiler and shorten the period of construction.

DETAILED DESCRIPTION OF THE PREFERRED EMBODIMENTS

The coal boiler and coal boiler combustion method according to the present invention will now be described with reference to the accompanying drawings.

First Embodiment

Figure 1:
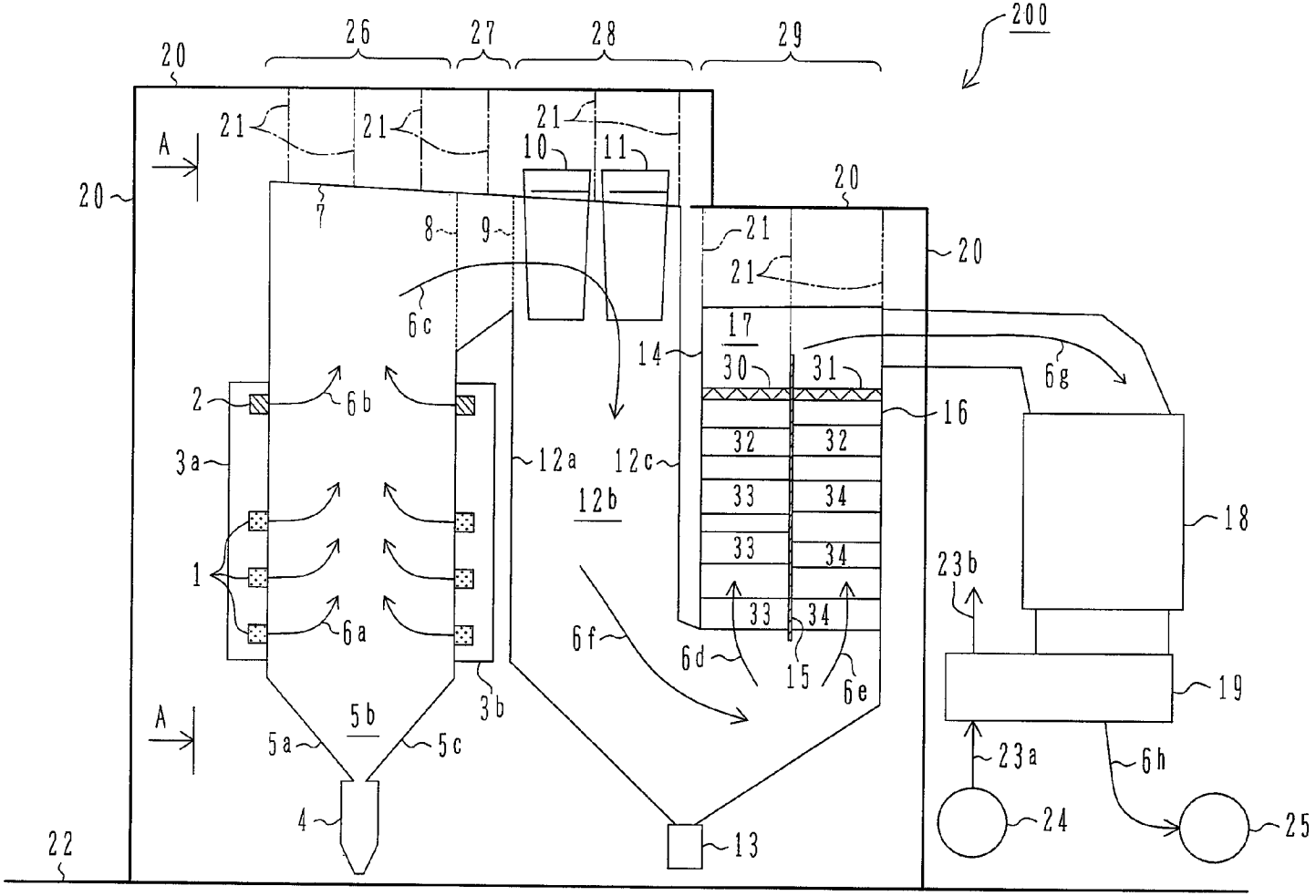
FIG. 1 is a side view illustrating a boiler according to a first embodiment of the present invention.
Figure 2:
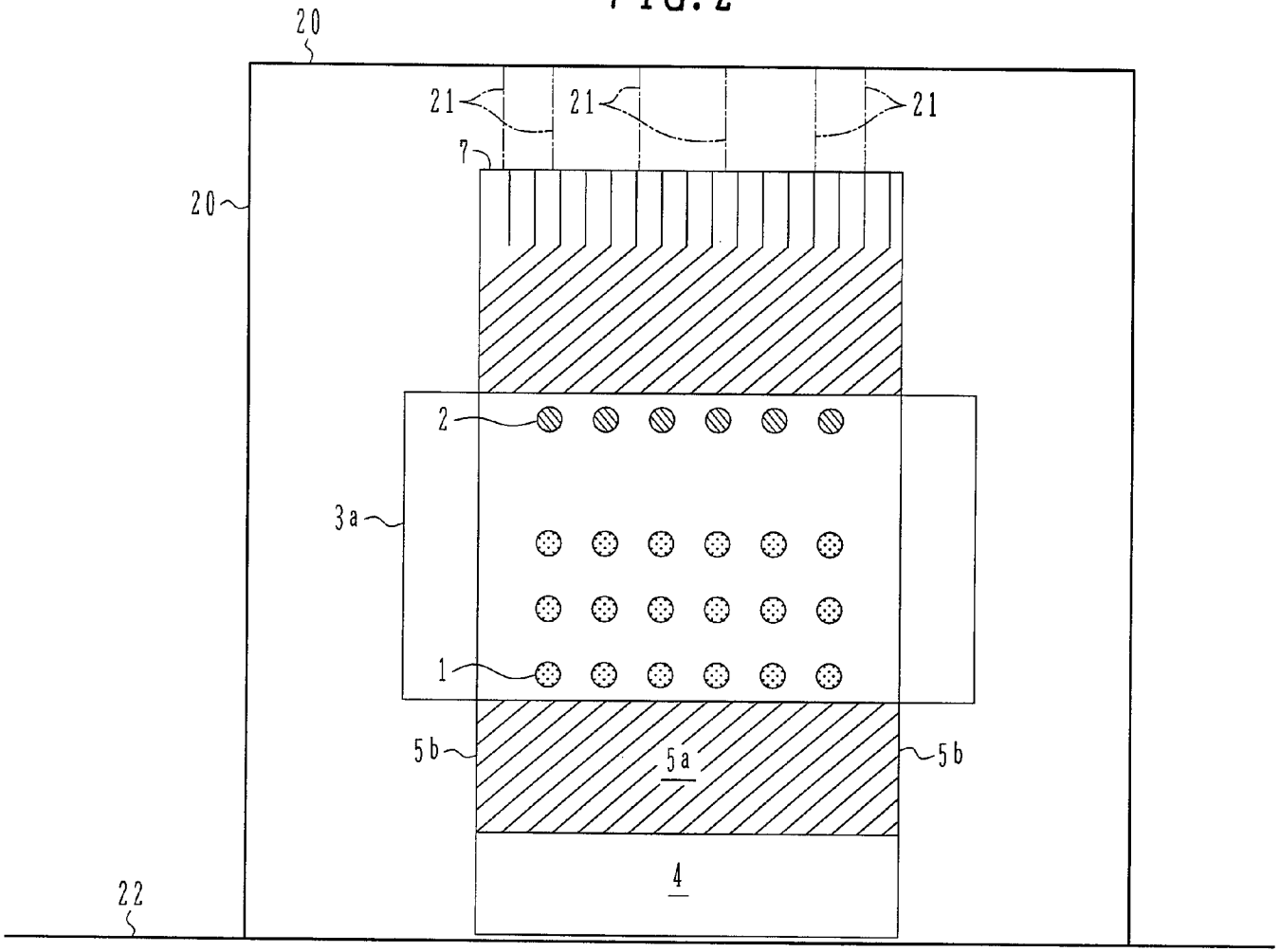
FIG. 2 is a front view illustrating the boiler according to the first embodiment of the present invention.

FIG. 1 is a side view illustrating a boiler according to a first embodiment of the present invention. FIG. 2 is a view of the boiler taken along line A-A in FIG. 1. The boiler 200 includes a first furnace 26, a furnace joint 27, a second furnace 28, and a heat recovery area 29. The boiler is housed in a building that is composed of an iron frame 20. FIG. 1 shows only the iron frame for the outer circumference of the building. In reality, however, many iron frames are employed to provide increased building strength.

The flue gas ejected from the heat recovery area 29 of the boiler 200 is discharged through a DeNOx device 18 for NOx removal, an air heater (e.g., an air heater 19 for heating air with flue gas), and an induced draft fan (e.g., IDF 25). In general, an electric precipitator, a desulfurization system (DeSOx system), a gas/gas heater, a chimney, and the like are installed downstream of the fan. The necessity of installing these devices is determined in accordance, for instance, with the type of fuel and design temperature.

The first furnace 26, the furnace joint 27, the second furnace 28, and the heat recovery area 29 are hung from a plurality of hanging wires 21 connected to the iron frame 20. Since a boiler wall expands due to heat, this configuration is employed to prevent the boiler and iron frame from being stressed.

Preheated air 23*b*, which is heated by the air heater 19, passes through a duct and is introduced into wind boxes 3*a*, 3*b*. Each wind box 3*a*, 3*b* is used to uniformly distribute air to many burners 1 and after-air ports (AAPs) 2. When pulverized coal is to be used as the fuel for the burners 1, the coal stored in a coal silo is pulverized with a coal pulverizer, and the resulting pulverized coal is supplied to the burners 1. When oil is to be used as the fuel for the burners 1, on the other hand, the oil is supplied from an oil tank to the burners 1 through a fuel pipe. For example, biomass, gas, or coke can also be supplied as the fuel for the boiler.

The first furnace 26 is composed by a front wall 5*a*, a side wall 5*b*, a rear wall 5*c*, and a roof wall 7. A water wall tube provided for these walls may be either spiral or vertical. The front wall 5*a* and rear wall 5*c* of the first furnace 26 are both provided with three-stage burners 1 and one-stage after-air ports 2. Six rows each of burners 1 and after-air ports 2 are arranged.

The fuel and oxidant are introduced from the burners 1. The subsequent explanation assumes that coal and air are to be burned. When the coal and air are supplied from the burners 1 and burned, a burner jet 6*a* is formed in the first furnace 26. Twenty to fifty burners 1 are installed to provide improved combustion quality. In an example shown in FIG. 1, two-stage after-air ports (AAPs) are installed. While the amount of air supplied from the burners 1 is rendered smaller than the amount of air required for complete combustion, the AAPs 2 supply additional air in the form of an AAP jet 6*b* to make up a shortfall and reduce the amount of NOx ejection from the boiler. The first furnace 26 uses the burner jet 6*a* and AAP jet 6*b* to generate a combustion gas 6*c*.

The combustion gas 6*c* generated by the first furnace 26 passes through the furnace joint 27 in which screen tubes 8, 9 are installed, and flows to the second furnace 28. The screen tubes 8 are used as members for maintaining furnace strength. A plurality of screen tubes 8 are positioned in parallel with the roof wall 7 so as to block a flow path of the combustion gas 6*c*. The two-pass boiler was designed so that the temperature of a gas passing through a screen tube is lower than the melting point of ash. This design was employed to prevent ash from adhering to the screen tube. Since the present embodiment divides the furnace into two, the first furnace 26 is not taller than the furnace of the two-pass boiler. Therefore, the gas temperature prevailing around the screen tubes 8 is higher than the melting point of ash. The boiler is designed so that the temperature of the screen tubes 8 does not exceed the upper-limit temperature of an employed material even when such conditions exist. It is preferred, for example, that a heat-resistant material be employed to resist high temperature or that low-temperature water be supplied to the screen tubes 8 for cooling purposes. Further, since ash is likely to adhere to the screen tubes 8, the spacing intervals between the screen tubes are increased. Spacing the screen tubes at intervals, for instance, of 1 m or longer reduces the possibility of the intervals between the screen tubes being blocked by ash.

Next, the combustion gas 6*c* passes through the screen tubes 9 and flows to the second furnace 28. The second furnace 28 is enclosed by a front wall 12*a*, a side wall 12*b*, a rear wall 12*c*, and the roof wall 7. These walls are made of a water wall tube that permits water or steam to flow. The water wall tube may be oriented either vertically or spirally. However, the thermal load on the second furnace 28 is relatively uniform as compared to the thermal load on the first furnace 26. Therefore, orienting the water wall tube vertically simplifies the furnace structure.

The combustion rate of the combustion gas 6*c* in the second furnace 28 can be adjusted by varying the air flow rate distribution by the burners 1 and AAPs 2. Decreasing the rate of mixture provided by the AAPs 2 can achieve NOx reduction. Using the furnace of a two-pass boiler for slow combustion increases the amount of unburned carbon such as CO. However, the combustion gas 6*c* in the three-pass boiler according to the present embodiment ascends in the first furnace 26, descends in the second furnace 28, and ascends in the heat recovery area 29. Therefore, there are two bends. The two bends mix the combustion gas discharged from the heat recovery area 29 to reduce the amount of unburned carbon. Further, this feature can be effectively used to conduct an operation with a reduced amount of air. In other words, it makes it possible to perform an operation at a low outlet oxygen concentration. As a result, the efficiency of a plant can be enhanced.

Superheaters 10, 11 are mounted on the roof wall 7 of the second furnace 28. Since the combustion gas temperature of the second furnace 28 is moderately high, the second furnace 28 is suitable for the installation of the superheaters 10, 11. In the second furnace 28, the combustion gas 6*c* flows downward. Since combustion has progressed in the second furnace 28, the combustion gas temperature and concentration do not significantly vary. Thus, the second furnace 28 is insusceptible to buoyancy. Subsequently, the combustion gas 6*f* flows to the heat recovery area. When the ash attached to the second furnace 28 and heat recovery area 29 is removed, it falls. Therefore, a device (ash hopper 13) for collecting and storing the ash is required. It is preferred that the ash hopper 13 be angled to avoid ash accumulation.

The heat recovery area 29 is enclosed by a front cage wall 14, a rear cage wall 16, and a side cage wall 17. Further, the heat recovery area 29 is provided with a heat exchanger that includes an economizer 32, a reheater 33, and a superheater 34. This heat exchanger is formed by bending a tube. The present embodiment relates to a reheating cycle that uses main steam and reheated steam for a steam turbine.

Parallel dampers 30, 31 are used to adjust the temperatures of the main steam and reheated steam. The combustion gas 6*f* is divided into combustion gases 6*d* and 6*e*. The ratio between the two combustion gases 6*d*, 6*e* is adjusted by the parallel dampers 30, 31. The associated two flow paths are separated by a partition 15 that is provided inside the heat recovery area 29. When, for instance, the reheated steam temperature is to be raised, the opening of the parallel dampers 30 should be increased to raise the flow rate of the combustion gas 6*d*.

The upstream combustion gas temperature is higher than the downstream combustion gas temperature. More specifically, the temperature of the gas passing through the reheater 33 and superheater 34 on the upstream side is high, whereas the temperature of the gas passing through the economizer 32 on the downstream side is low. Heat recovery from a low-temperature combustion gas can be effectively achieved by raising the combustion gas flow rate for heat transfer coefficient enhancement. Thus, heat transfer tubes of the economizer 32 are spaced at narrow intervals. As regards the boiler according to the present embodiment, the heat transfer tubes of a heat exchanger positioned downstream (placed at an upper position) are spaced at relatively narrow intervals, whereas the transfer tubes of a heat exchanger positioned upstream (placed at a lower position) are spaced at relatively wide intervals. The reverse is the case with a two-pass boiler. Therefore, when the ash attached to a heat exchanger is removed, for instance, with a soot blower, the removed ash falls into a heat exchanger having transfer tubes spaced at wide intervals. This prevents the combustion gas flow path from being blocked, thereby providing enhanced boiler reliability.

As described above, the two-pass boiler has only one furnace, whereas the furnace of the three-pass boiler according to the present embodiment is divided into two. When the height of a furnace is decreased by dividing the furnace into two, it is possible to reduce the necessity of performing high-place work with a crane or the like and lifting a heavy item against gravity. Further, as the lower structure of a furnace is integral with the upper structure, the lower structure cannot be assembled until the upper structure is assembled. Therefore, dividing the furnace into two doubles the work speed. As described above, dividing the furnace into two makes it possible to reduce the height of the boiler (furnace) and shorten the period of construction.

When the furnace capacity is increased, the combustion time can be reduced while avoiding a cost increase. This makes it possible to reduce the NOx concentration and decrease the amounts of CO and UBC (unburned carbon in ash). When the furnace capacity of a two-pass boiler is increased, the furnace height increases. However, the three-pass boiler according to the present invention makes it possible to decrease the furnace height while minimizing the combustion time for the combustion gas.

Second Embodiment

Figure 3:
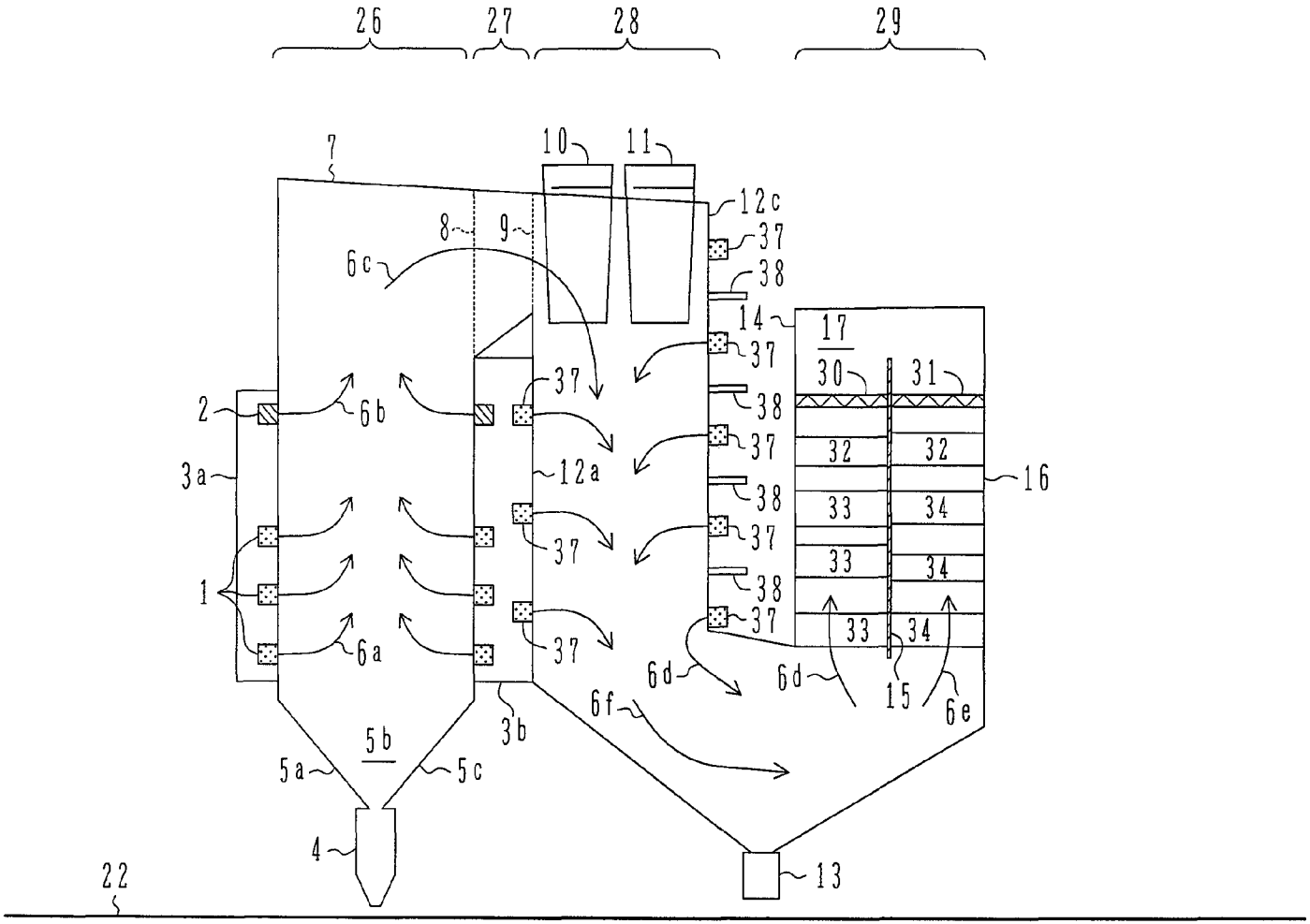
FIG. 3 is a side view illustrating a boiler according to a second embodiment of the present invention.

FIG. 3 is a side view illustrating a boiler according to a second embodiment of the present invention. The second embodiment is structured to decrease the amounts of NOx and CO to a greater extent than the first embodiment.

A NOx generation mechanism can be roughly divided into two types. One of them generates fuel NOx from nitrogen in fuel. The other generates thermal NOx by allowing nitrogen in the air to oxidize. Referring to FIG. 3, the amount of fuel NOx is decreased by staged combustion. The amount of thermal NOx can be reduced by lowering the combustion gas temperature. For such purposes, the amount of air ejection from the AAPs and the rate of such ejection are important.

In the present embodiment, many AAPs 37 are provided for the second furnace 28 in addition to the AAPs 2 for the first furnace 26. The flow rates and ejection rates of such AAPs 2 and AAPs 37 are regulated to control the amounts of NOx and unburned carbon. If, for instance, the air ejected from the AAPs rapidly mixes with the combustion gas, a local gas temperature rise occurs to increase the amount of thermal NOx.

Figure 4:
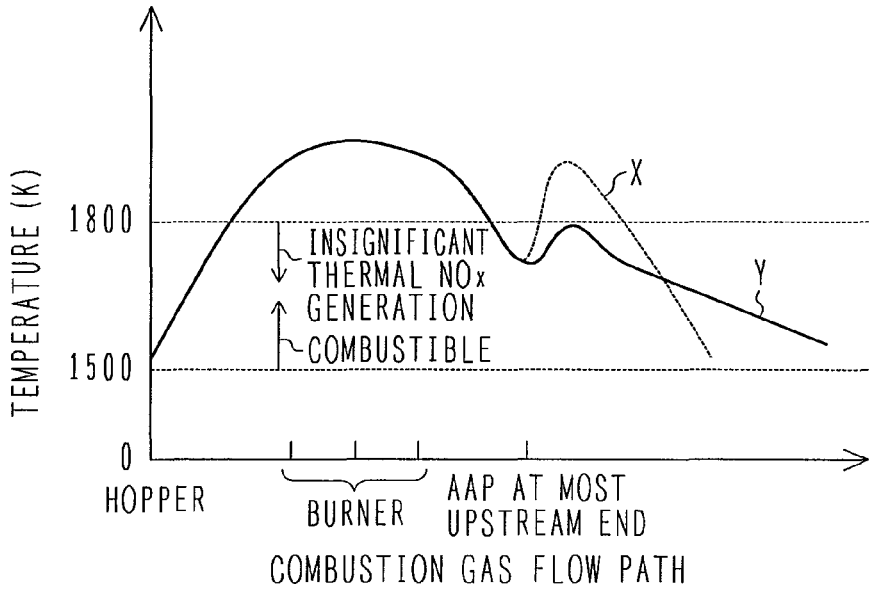
FIG. 4 is a conceptual diagram illustrating a combustion field according to the second embodiment of the present invention.
Figure 4:
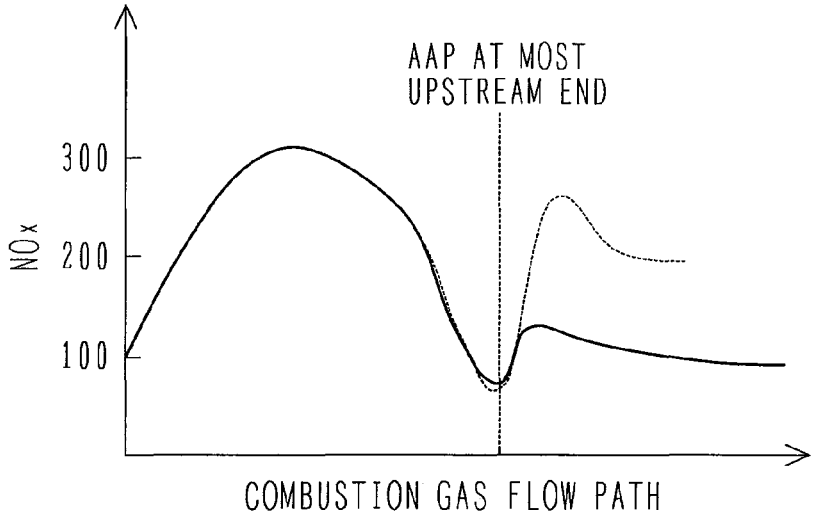

FIG. 4 shows an example of combustion gas temperature control. The upper diagram in FIG. 4 shows combustion gas temperature changes within a furnace. The horizontal axis of this diagram indicates a location in a combustion gas flow path that connects the first furnace 26, the furnace joint 27, and the second furnace 28, whereas the vertical axis indicates temperature. The lower diagram in FIG. 4 shows NOx amount changes in the combustion gas in a furnace. The horizontal axis of this diagram indicates the same as the counterpart in the upper diagram whereas the vertical axis indicates the amount of NOx.

When the combustion gas temperature exceeds 1800 K, the amount of thermal NOx tends to increase sharply as shown in FIG. 4 (graph X in FIG. 4). More specifically, when an AAP positioned at the most upstream end supplies air to the combustion gas ejected from a burner 1, the amount of air ejection from the AAP is controlled so that combustion takes place at a temperature of not higher than 1800 K (graph Y in FIG. 4). It should be noted that the "AAP positioned at the most upstream end" is the AAP positioned at the most upstream end within the combustion gas flow path connecting the first furnace 26, the furnace joint 27, and the second furnace 28. Therefore, the "AAP positioned at the most upstream end" in FIG. 3 is an AAP 2 that is provided for the first furnace 26.

When the combustion gas temperature falls below 1500 K, the rate at which coal particles of pulverized coal and solid particles of unburned carbon (e.g., soot) generated in a combustion process burn decreases. To reduce the amount of unburned carbon while minimizing the amount of NOx generation, it is therefore preferred that combustion take place at a temperature between 1500 K and 1800 K. As described above, the increase in NOx concentration can be minimized by controlling the amount of air ejection from the "AAP positioned at the most upstream end" in the above-mentioned manner.

The boiler shown in FIG. 3 adjusts the flow rate of air to be supplied from many AAPs 37 that are provided for the second furnace 28. However, if the amount of air supplied from the AAPs 2 provided for the first furnace 26 is small, the combustion gas 6*c* contains a large amount of fuel rich gas. Therefore, the first furnace 26 and furnace joint 27 may corrode. To reduce the degree of corrosion, it is preferred that the oxygen concentration of the combustion gas 6*c* be adjusted to approximately 0.5% after subjecting the air ejected from the AAPs 2 to mixture. It is also preferred that the upper structure of the first furnace 26 and the furnace joint 27 be made of a corrosion-resistant material.

To further reduce the amount of NOx, it is preferred that ammonia, urea, or other NOx reducing agent be supplied from a port or ports 38 of the second furnace 28. This approach is referred to as a noncatalytic NOx reduction method. Further, the amount of NOx can be reduced by supplying methane or other combustible gas from the port or ports 38 for reburning purposes.

Third Embodiment

Figure 5:
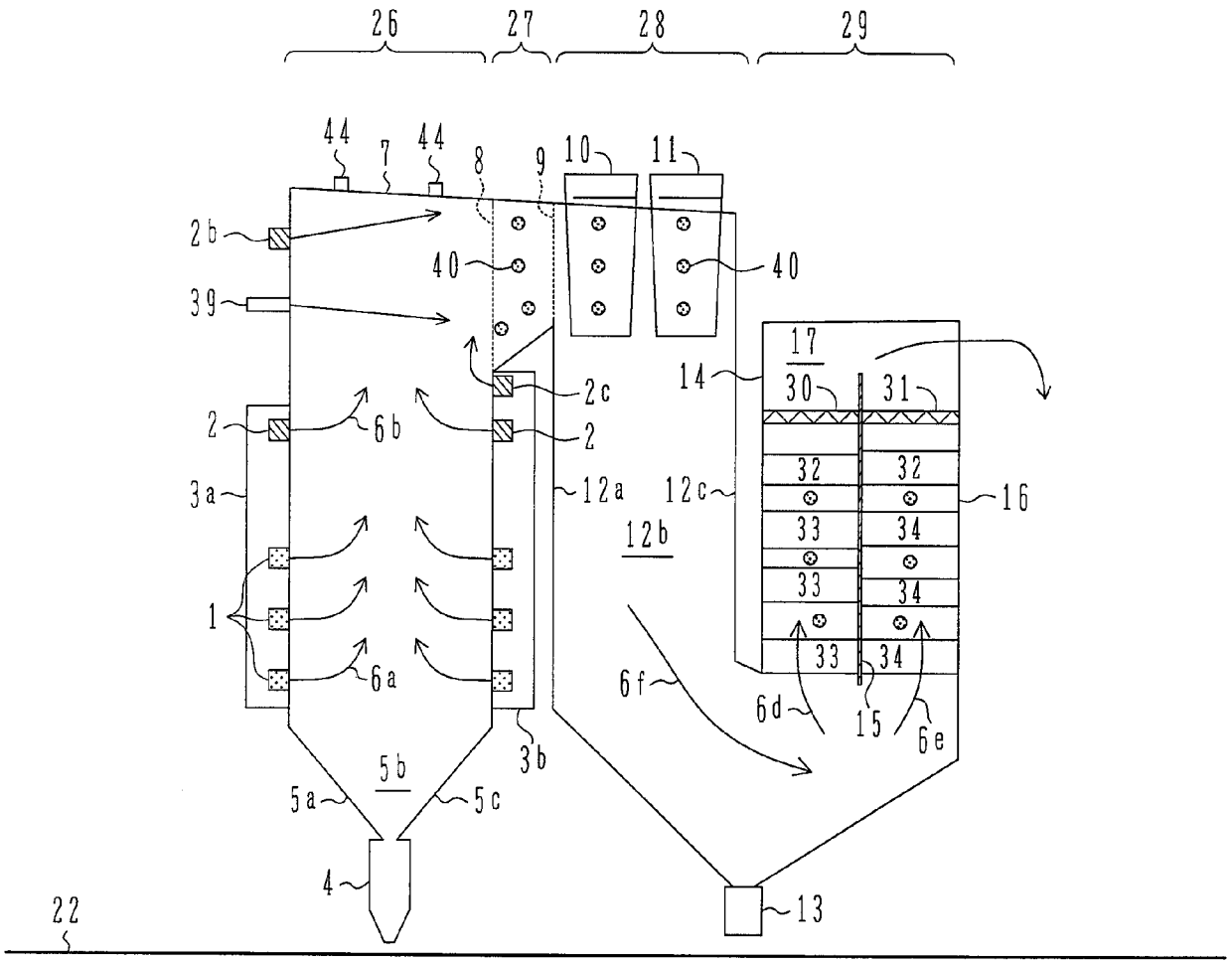
FIG. 5 is a side view illustrating a boiler according to a third embodiment of the present invention.

FIG. 5 is a side view illustrating a boiler according a third embodiment of the present invention. The third embodiment will be described mainly with reference to a structure for reducing the amount of ash adhesion.

Ash mainly adheres to the roof wall 7 of the first furnace 26 and to an area close to the furnace joint 27. If the ash adheres to the roof wall 7 of the first furnace 26, it is preferred that an AAP 2*b* be oriented toward the roof wall 7 for ejection and cooling purposes. FIG. 5 indicates that the AAP 2*b* is mounted on the upper part of the front wall 5*a* of the first furnace 26.

If the ash adheres to the screen tubes 8, it can be dropped with a water sprayer (e.g., water cannon 39). FIG. 5 indicates that the water cannon 39 is mounted on the front wall 5*a* of the first furnace and positioned between the AAPs 2 and AAP 2*b*. The ash attached to the bottom of the screen tubes 8, 9 is likely to accumulate on the bottom of the furnace joint 27. An AAP 2*c* is therefore added to seal the lower part of the furnace joint 27 for the purpose of avoiding such ash accumulation. Alternatively, an ash removal device (e.g., soot blower 40) may be mounted on a side wall of the furnace joint 27. As regards the boiler according to the present embodiment, the furnace joint 27 should be provided with many ash removal devices (e.g., soot blowers 40). Ash removal devices (e.g., wall blowers 44) should also be installed to remove the ash attached to the roof wall 7. The wall blowers 44 are mounted on the roof wall 7.

The combustion gas that has flowed to the second furnace 28 passes through the pendant superheaters 10, 11. Ash removal devices (e.g., soot blowers 40) are installed to remove the ash attached to the pendant superheaters 10, 11. The bottom of the second furnace 28 is inclined to avoid the accumulation of the ash that falls from the pendant superheaters 10, 11. The heat recovery area 29 is also provided with many ash removal devices (e.g., soot blowers).

Fourth Embodiment

Figure 6:
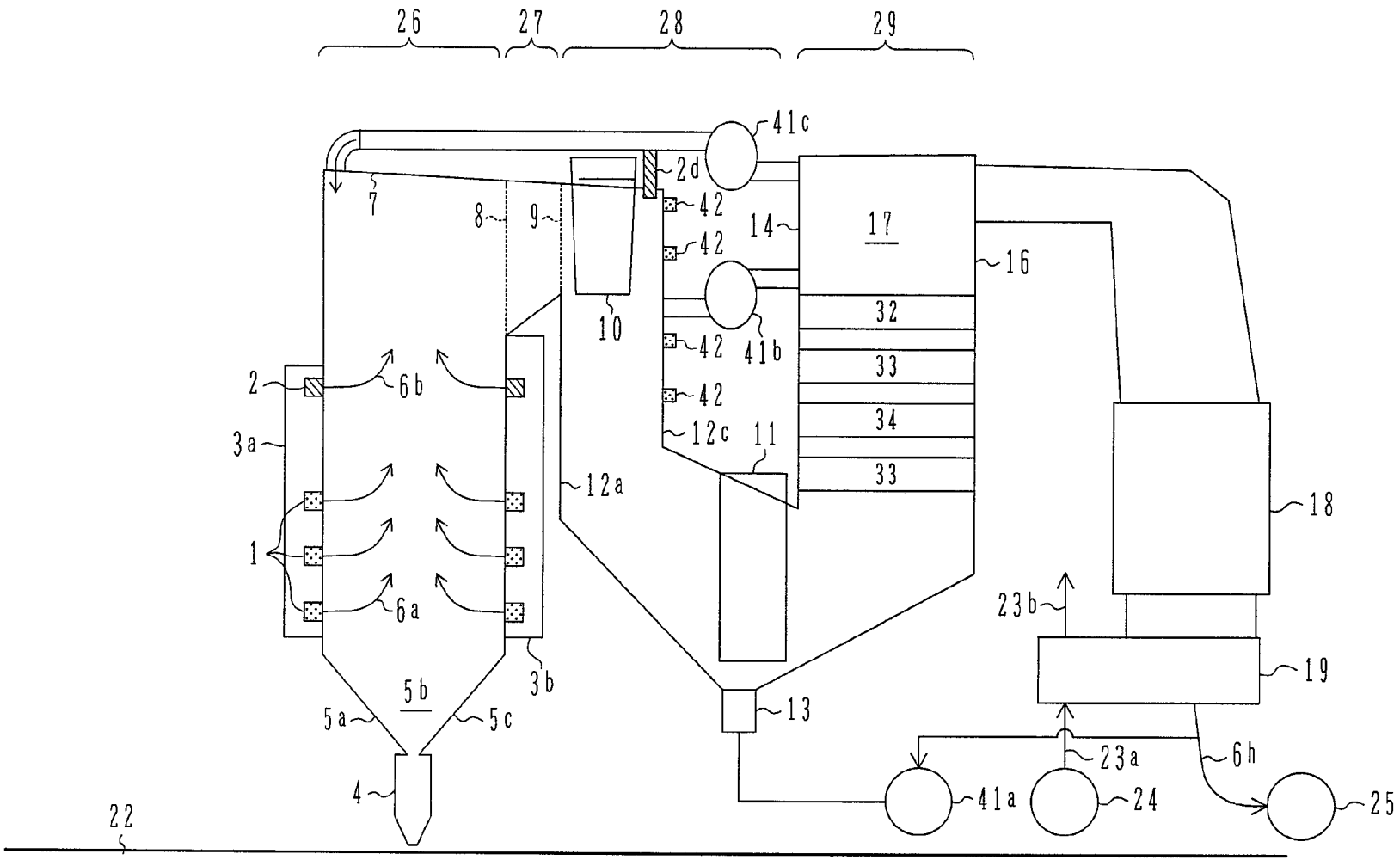
FIG. 6 is a side view illustrating a boiler according to a fourth embodiment of the present invention.

FIG. 6 is a side view illustrating a boiler according to a fourth embodiment of the present invention. The fourth embodiment differs from the other embodiments in that the former uses a different method of adjusting the temperature of steam to be generated by the boiler. The boiler shown in FIG. 6 differs from the one shown in FIG. 1 in that the pendant superheater 11 is positioned downstream of the second furnace 28, and that the heat recovery area 29 does not have a partition.

Referring to FIG. 6, part of the flue gas discharged from the air heater 19 is returned to the second furnace 28 by a gas recirculation fan 41*a* and used to adjust the amount of heat absorption by the water wall tube. In most cases, the flue gas temperature roughly ranges from 100° C. to 150° C. The flue gas is used to adjust the steam temperature of a reheated steam system. When, for instance, the rate of flue gas flow to the second furnace 28 is increased, the combustion gas temperature of the second furnace 28 decreases. This reduces the amount of heat transfer by the pendant superheater 11, which mainly provides radiant heat transfer. In the present embodiment, the pendant superheater 11 and reheater 33 decrease the amount of heat transfer for the same reason. The superheater 34 and economizer 32 mainly provide convective heat transfer. Therefore, when the flue gas is supplied to increase the combustion gas flow rate of the heat recovery area 29, the combustion gas flow velocity increases to increase the amount of heat transfer by the superheater 34 and economizer 32.

An alternative is to connect the downstream end of the economizer 32 to the second furnace 28 with a gas flow path and supply the combustion gas to the second furnace 28 through a gas recirculation fan 41*b*. The use of this alternative makes it possible to decrease the gas temperature of the second furnace 28 and avoid ash adhesion. Particularly, the gas temperature of the rear wall 12*c* of the second furnace can be decreased to inhibit ash adhesion. The gas temperature of the second furnace 28 should be approximately 350° C.

In the present embodiment, the depth of the second furnace 28 is smaller than in the first embodiment. This design is not essential to a configuration that includes the gas recirculation fan 41*b*. In such a configuration, it is likely that ash may adhere to the rear wall 12*c* of the second furnace. Therefore, many ash removal devices (e.g., soot blowers 42) are mounted on the wall surface. Further, an AAP 2*d* can be mounted on the roof of the second furnace 28 to avoid ash adhesion to the rear wall. Although the structure for minimizing the amount of ash adhesion to the rear wall is described here, the same method can be applied to the front wall and side wall.

Another alternative is to connect the downstream end of the economizer 32 to the first furnace 26 with a gas flow path and return low-temperature flue gas to the first furnace 26 with a gas recirculation fan 41*c*. When the low-temperature flue gas returns, it can be used to cool the roof wall 7.

Fifth Embodiment

Figure 7:
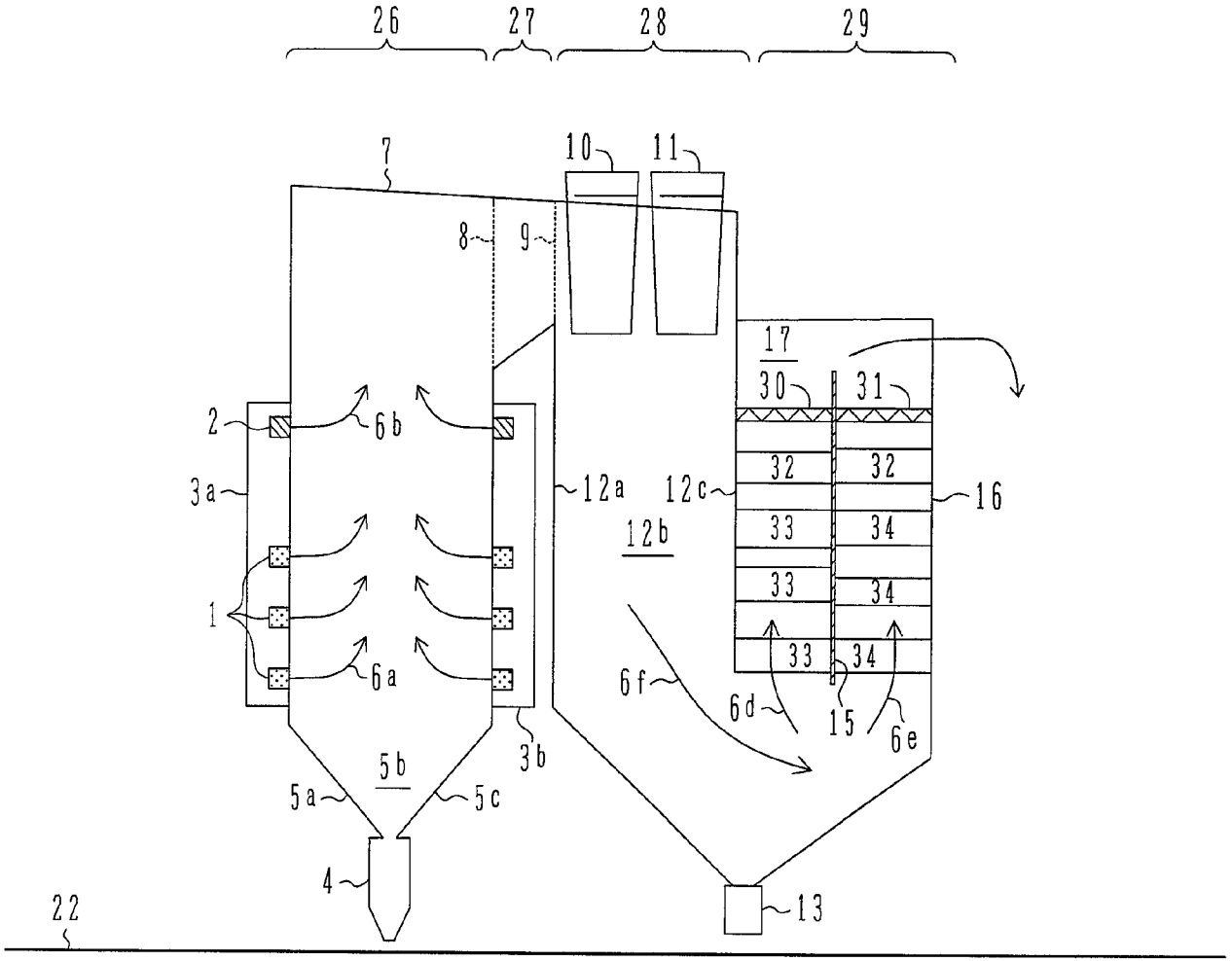
FIG. 7 is a side view illustrating a boiler according to a fifth embodiment of the present invention.

FIG. 7 is a side view illustrating a boiler according to a fifth embodiment of the present invention. The boiler shown in FIG. 7 differs from the one shown in FIG. 1 in that the rear wall 12*c* of the second furnace 28 is integral with the front wall of the heat recovery area 29. The use of this structure reduces the number of required members. In this case, however, it is well to remember that thermal expansion occurs to generate stress when the side wall 12*b* of the second furnace, the rear wall 12*c* of the second furnace, and the cage wall 17 of the heat recovery area 29 are welded together. To avoid such a problem, it is necessary to design the boiler so that the temperatures of water and steam passing through the above sections are uniform wherever possible.

Sixth Embodiment

Figure 8:
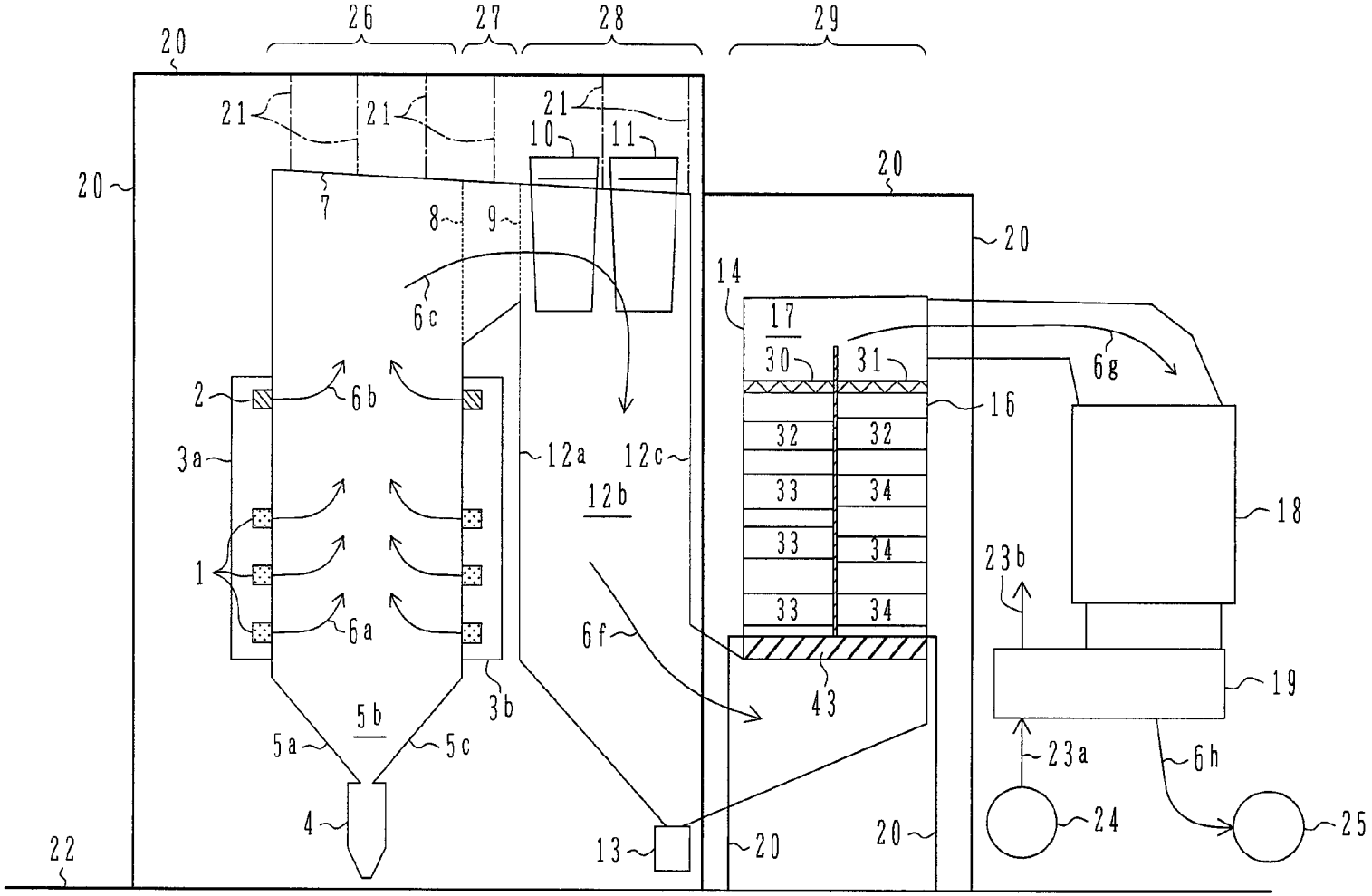
FIG. 8 is a side view illustrating a boiler according to a sixth embodiment of the present invention.

FIG. 8 is a side view illustrating a boiler according to a sixth embodiment of the present invention. In the sixth embodiment, a joint member (joint 43) that resists high-temperature gas is employed as the joint between the second furnace 28 and heat recovery area 29. Further, a ground-supported, free-standing heat recovery area 29 is employed instead of a pendant type. The free-standing type reduces the construction period and cost because it can be constructed more easily than the pendant type. The two-pass boiler could not use the free-standing type because the heat recovery area 29 was mounted on a high part of a furnace. The present embodiment can use the free-standing type because the heat recovery area 29 is positioned close to the ground.

Figure 9:
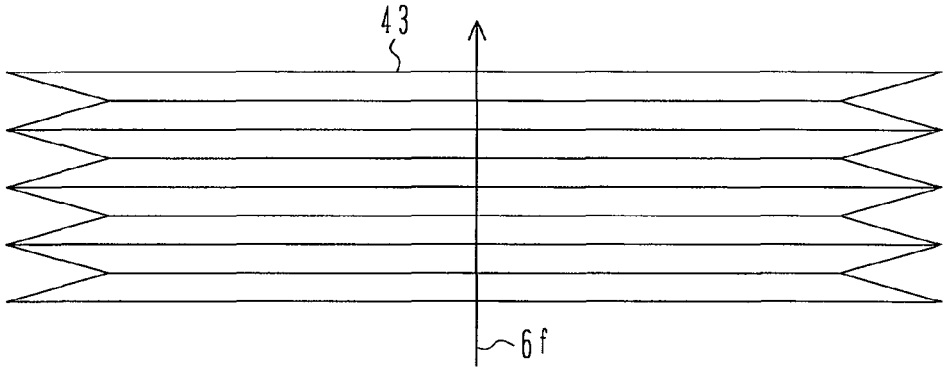
FIG. 9 shows a joint according to the sixth embodiment of the present invention.
Figure 10:
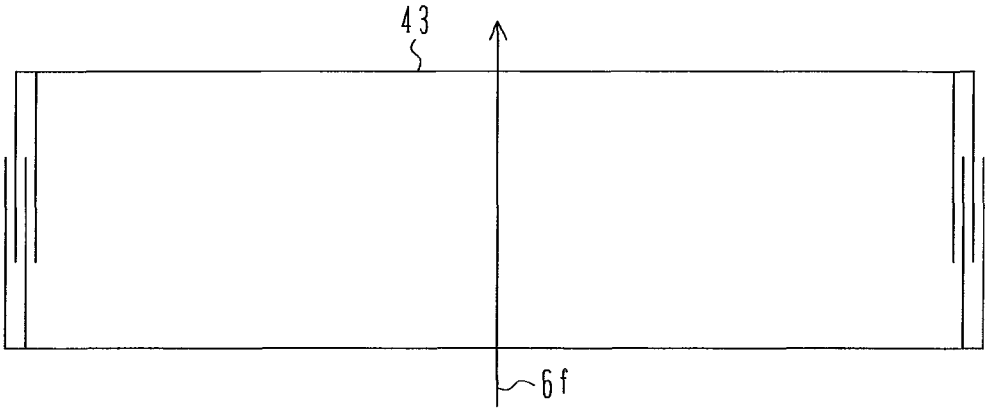
FIG. 10 shows a joint according to the sixth embodiment of the present invention.

Since the temperature of the combustion gas 6*f* passing through the joint 43 is approximately 1000° C., it is necessary that the joint 43 resist such a high temperature. In addition, since the upper structure of the second furnace 28 is fixed, the second furnace 28 expands downward when the temperature of its material rises. Meanwhile, since the lower structure of the heat recovery area 29 is fixed, the heat recovery area 29 expands upward when the temperature of its material rises. Thus, the joint 43 needs to absorb both of these expansions. The expansions can be absorbed by using a bellows that is shown in FIG. 9 or by using a slide that is shown in FIG. 10.

Seventh Embodiment

Figure 11:
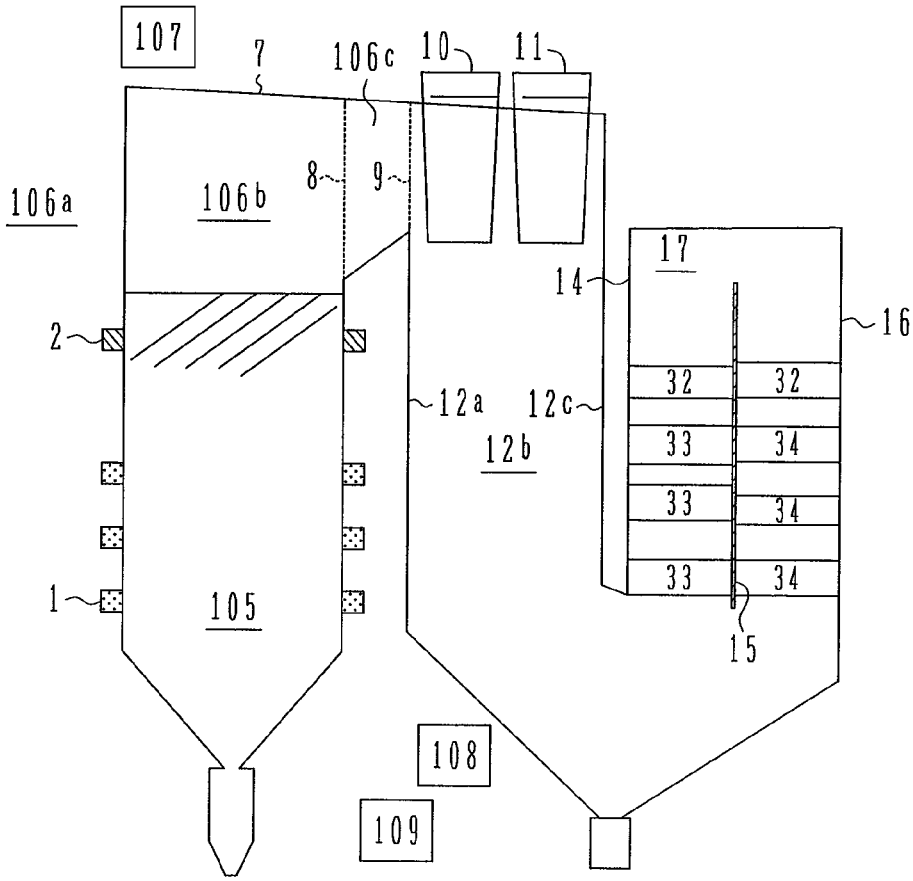
FIG. 11 is a side view illustrating a boiler according to a seventh embodiment of the present invention.
Figure 12:
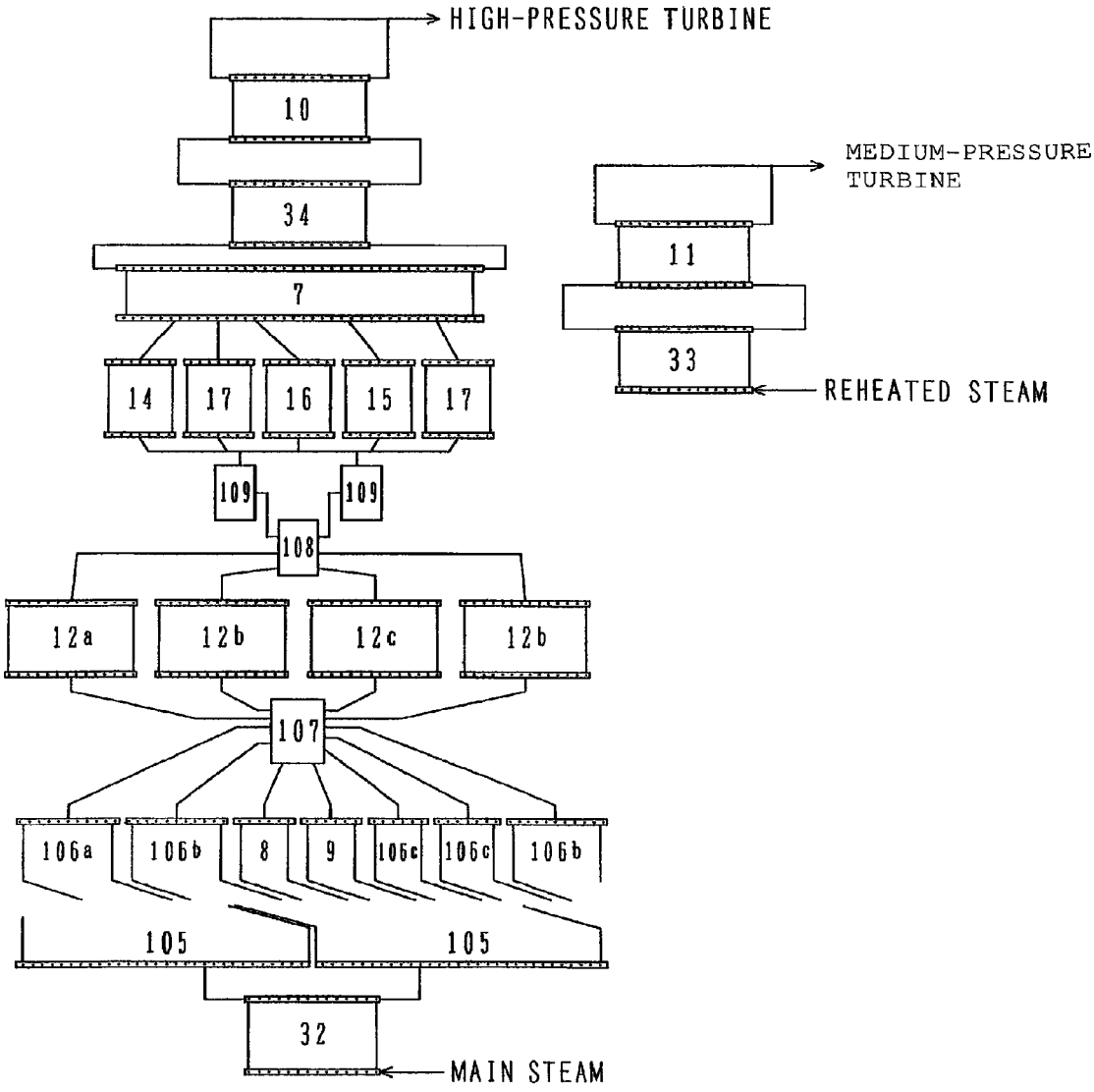
FIG. 12 shows a steam flow path according to the seventh embodiment of the present invention.

FIG. 11 is a side view illustrating a boiler according to a seventh embodiment of the present invention. FIG. 12 shows a steam flow path of the boiler shown in FIG. 11. A water supply pump is used so that a condenser supplies water to the economizer 32. The economizer 32 warms the water and supplies it to the bottom 105 of a first furnace water wall. Since the furnace shown in FIG. 11 has a spiral wall, the water wall tubes are laid around the outer circumference of the furnace and connected to the upper structure. Further, the water wall tubes are positioned vertically on the tops 106*a*, 106*b* of the first furnace water wall. The use of the vertical water wall tubes simplifies the structure. When the tops 106*a*,

106*b* of the first furnace water wall have a spiral structure, the water wall tubes provide uniform heat absorption. Rear wall water tubes branch into the screen tubes 8 and the top 106*c* of the first furnace water wall and connect to the upper structure. When the tops of the first furnace are reached, the water is supplied to a mixing header 107, which mixes water and steam of each tube, for the purpose of making the water and steam temperatures uniform.

The water and steam from the mixing header 107 flow downward along the front wall 12*a*, side wall 12*b*, and rear wall 12*c* of the second furnace. When a gas-liquid two-phase downward flow occurs, evaporation may slow down because a liquid phase rapidly falls by gravity. Therefore, ribbed tubes or other tubes exhibiting high heat transfer efficiency should be used to accelerate the mixture within the tubes.

Next, the steam flows to a mixing header 108 and then to a water-steam separator 109, which separates the water and steam. The boiler should be designed so that the water almost evaporates when the bottom of the second furnace is reached. Construction is easy because the heavy mixing header 108 and the water-steam separator 109 can be installed at a low place slightly above the ground. The water separated by the water-steam separator 109 returns to a water supply line through a water storage tank and a boiler circulation pump (BCP). If the water-steam separator 109 is not installed, the water stays at the bottom so that there is no steam flow in some tubes. Although the figure indicates that two mixing headers and one water-steam separator are installed, the number of such units should be adjusted as needed.

Next, the steam separated by the water-steam separator 109 is distributed to the heat recovery area cage walls 14, 16, 17 and partition 15. Since the steam ascends, the length of the tubing between the mixing header and the above walls is reduced.

Next, the steam is supplied to the roof wall 7. If the steam temperature is unbalanced, a mixing header should be installed before the roof wall 7.

Next, the steam is superheated by the superheater 34 and further superheated by the pendant superheater 10. A device (sprayer) for supplying a low-temperature fluid should be installed before and after the superheater 34 and pendant superheater 10 in order to adjust the temperature of the steam. The steam discharged from the pendant superheater 10 is supplied to a high-pressure turbine.

After being used in the high-pressure turbine, the steam is returned to the boiler water wall tubes as reheated steam. The returned reheated steam is then supplied to an intermediate-pressure turbine through the reheater 33 and pendant superheater 11. The use of the above route makes it possible to decrease the length of tubing and reduce the degree of steam/metal temperature unbalance.

Eighth Embodiment

Figure 13:
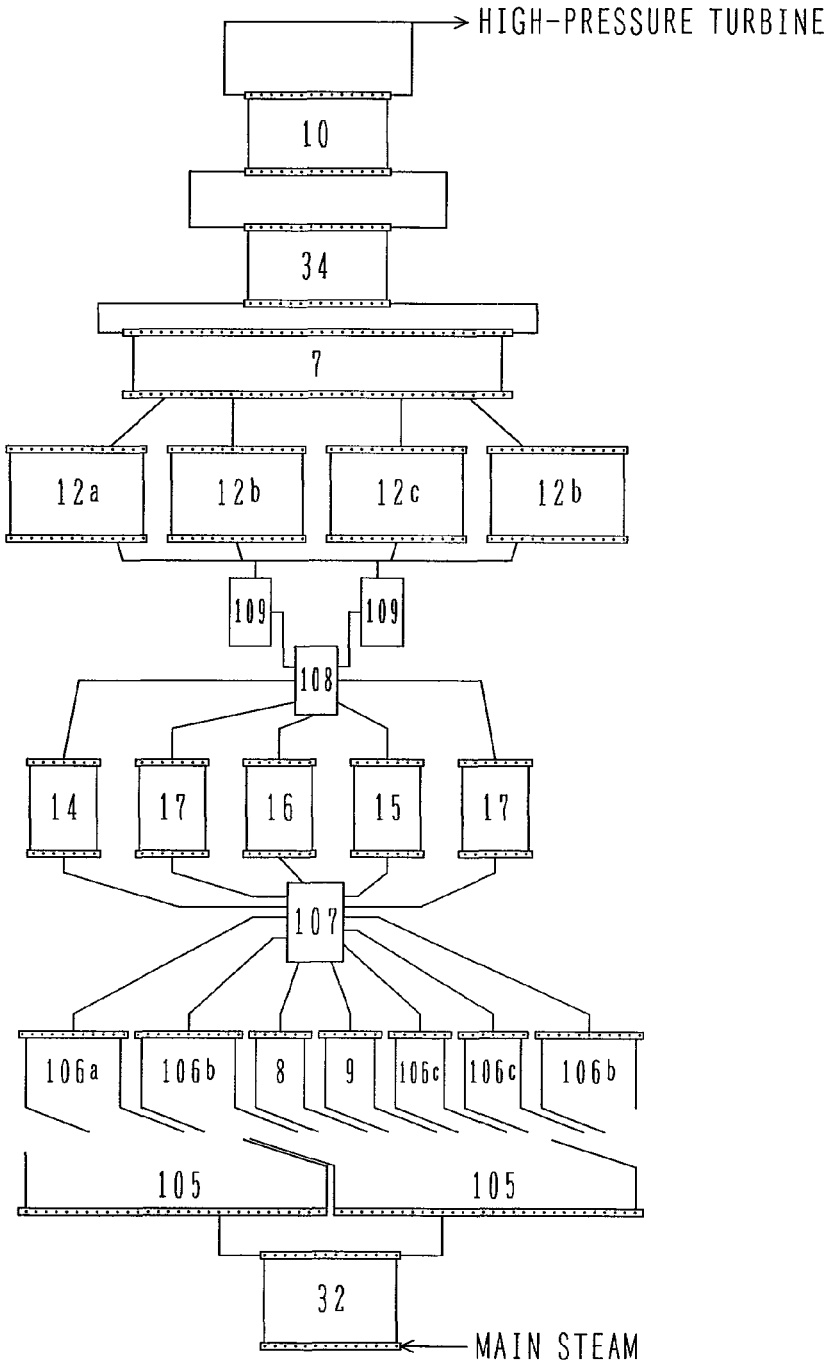
FIG. 13 shows a steam flow path according to an eighth embodiment of the present invention.

FIG. 13 shows a steam flow path according to an eighth embodiment of the present invention. The eighth embodiment differs from the seventh embodiment in the sequence of water/steam flow. As is the case with the seventh embodiment, the water discharged from the economizer 32 enters the bottom 105 of the first furnace water wall. Subsequently, the water enters the mixing header 107 through the tops 106*a*, 106*b*, 106*c* of the first furnace water wall and the screen tubes 8, 9. The water-steam mixture then descends along the heat recovery area cage walls 14, 16, 17 and partition 15. Since the heat load on the cage walls is lower than that on the second furnace 28, a metal temperature rise and other problems are not likely to occur when a downward flow occurs. The water-steam mixture that has descended along the heat recovery area cage walls 14, 16, 17 and partition 15 is collected by the mixing header 108 and separated into water and steam by the water-steam separator 109. The separated steam descends along the front wall 12*a*, side wall 12*b*, and rear wall 12*c* of the second furnace and is supplied to the roof wall 7. The steam supplied to the roof wall 7 then flows along the same path as indicated in FIG. 12.

Ninth Embodiment

Figure 14:
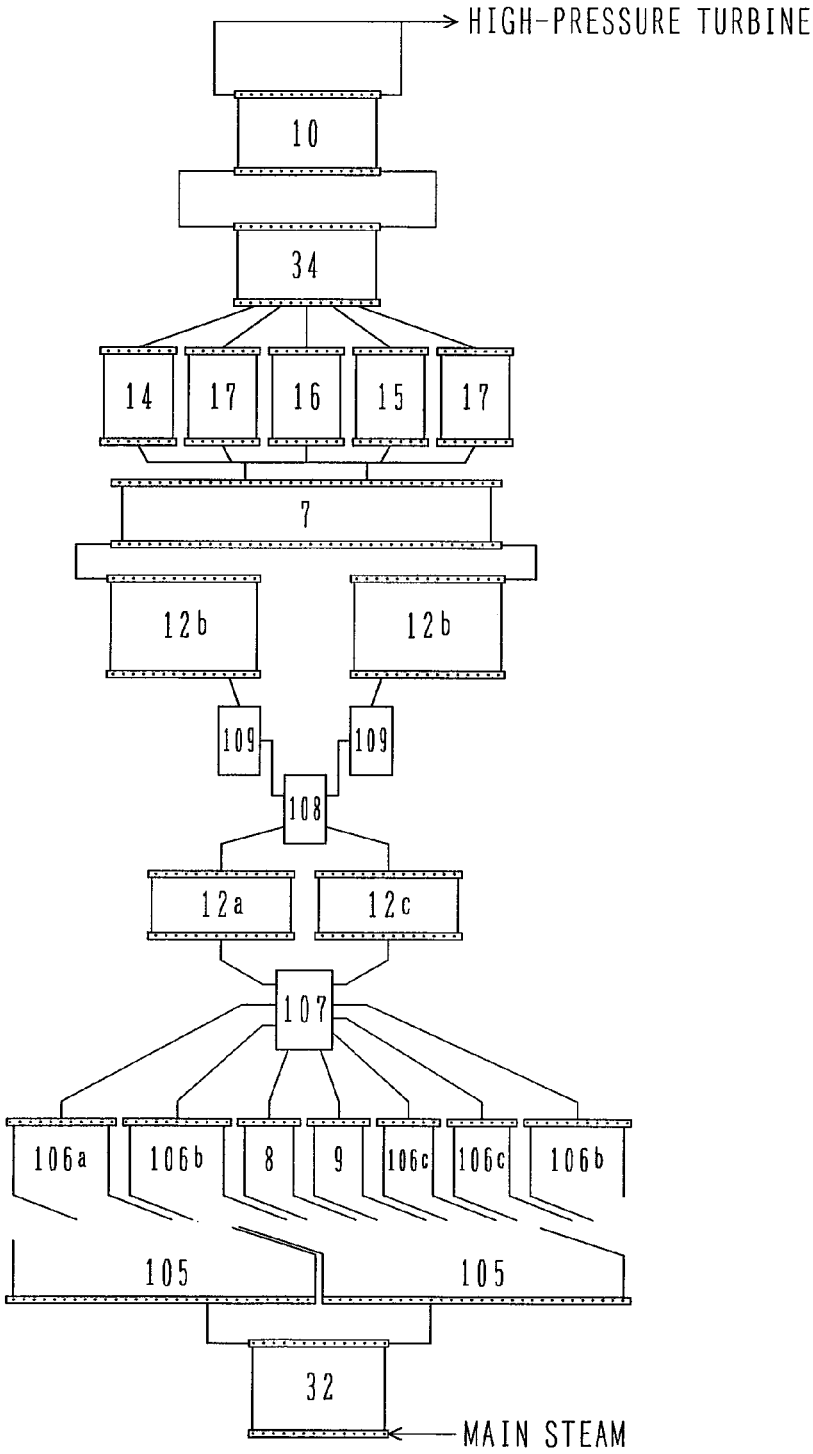
FIG. 14 shows a steam flow path according to a ninth embodiment of the present invention.

FIG. 14 shows a steam flow path according to a ninth embodiment of the present invention. The ninth embodiment differs from the seventh and eighth embodiments in the sequence of water/steam flow. As is the case with the seventh embodiment, the water discharged from the economizer 32 enters the bottom 105 of the first furnace water wall. Subsequently, the water enters the mixing header 107 through the tops 106*a*, 106*b*, 106*c* of the first furnace water wall and the screen tubes 8, 9. The water-steam mixture then descends along the front wall 12*a* and rear wall 12*c* of the second furnace. Next, the water-steam mixture passes through the mixing header 108 and water-steam separator 109, then only the steam reaches the side wall 12*b* of the second furnace and ascends. In this case, a large amount of heat is transferred along the front wall 12*a* and rear wall 12*c* of the second furnace. Therefore, the present embodiment is suitable for a situation where great thermal expansion occurs.

Tenth Embodiment

Figure 15:
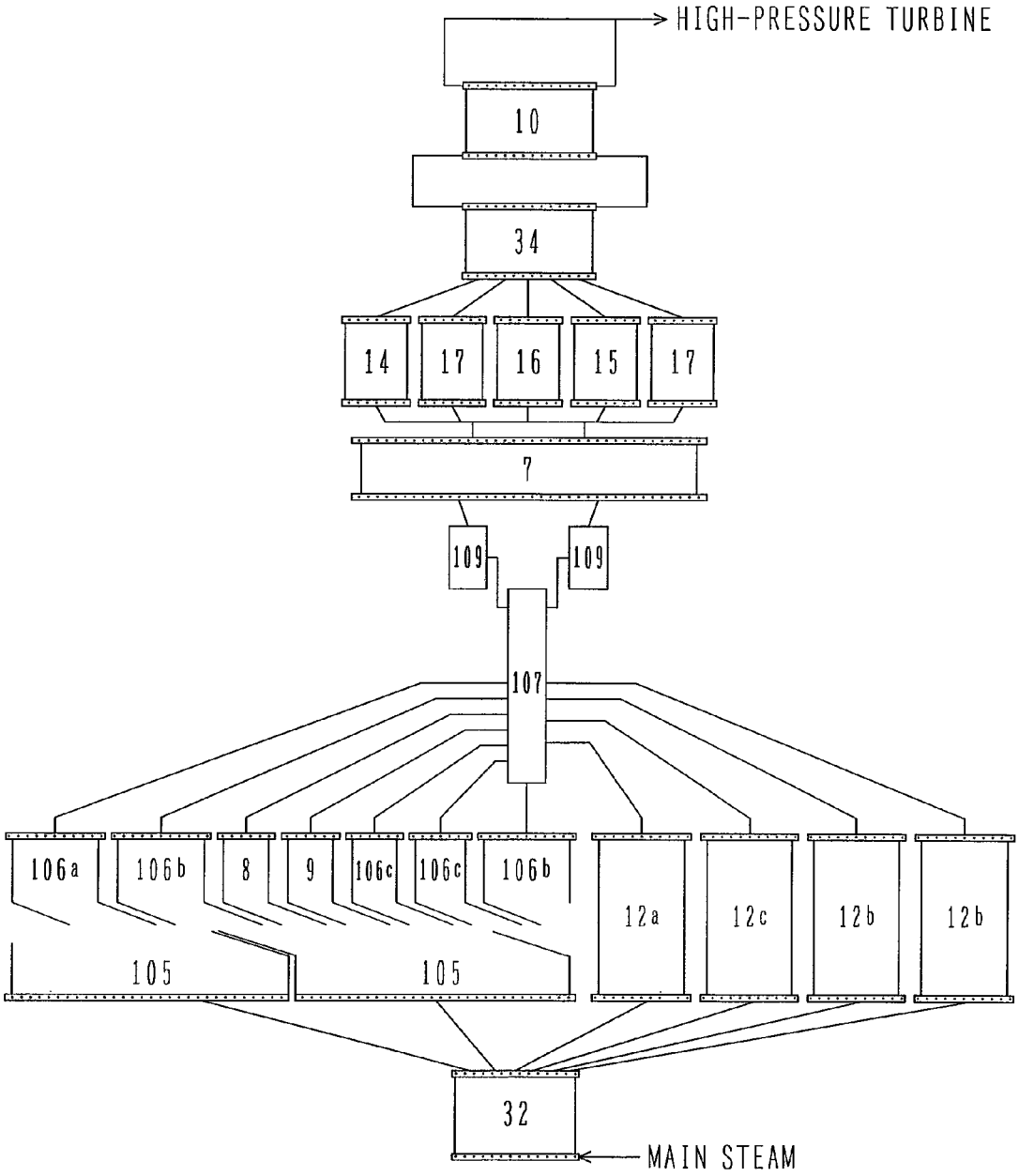
FIG. 15 shows a steam flow path according to a tenth embodiment of the present invention.

FIG. 15 shows a steam flow path according to a tenth embodiment of the present invention. The water discharged from the economizer 32 is supplied by distributing it to the bottom 105 of the first furnace water wall, the front wall 12*a* of the second furnace, the side wall 12*b* of the second furnace, and the rear wall 12*c* of the second furnace. The water and steam generated from these heat transfer surfaces are mixed by the mixing header 107 and separated into water and steam by the water-steam separator 109. The steam flows to the cage walls 14, 16, 17 via the roof wall 7. The use of this method simplifies the boiler structure because the use of water/steam tubing is minimized.

It should be noted that the mass flow rate of each water wall tube decreases because the furnace connected to the economizer 32 is large in size. In this case, DNB (Departure from Nucleate Boiling) may occur to significantly raise the metal temperature. The boiler should be designed in consideration of such DNB. Further, even when the mass flow rate decreases, a change from liquid phase to gas phase quickly occurs in a water wall tube that transfers a large amount of heat. This decreases the amount of pressure loss. Consequently, the flow rate increases to decrease the amount of temperature rise. This advantage can be effectively used to enlarge a flow velocity design rage without sacrificing reliability. In addition, the pressure loss of a furnace can be reduced.

Eleventh Embodiment

Figure 16:
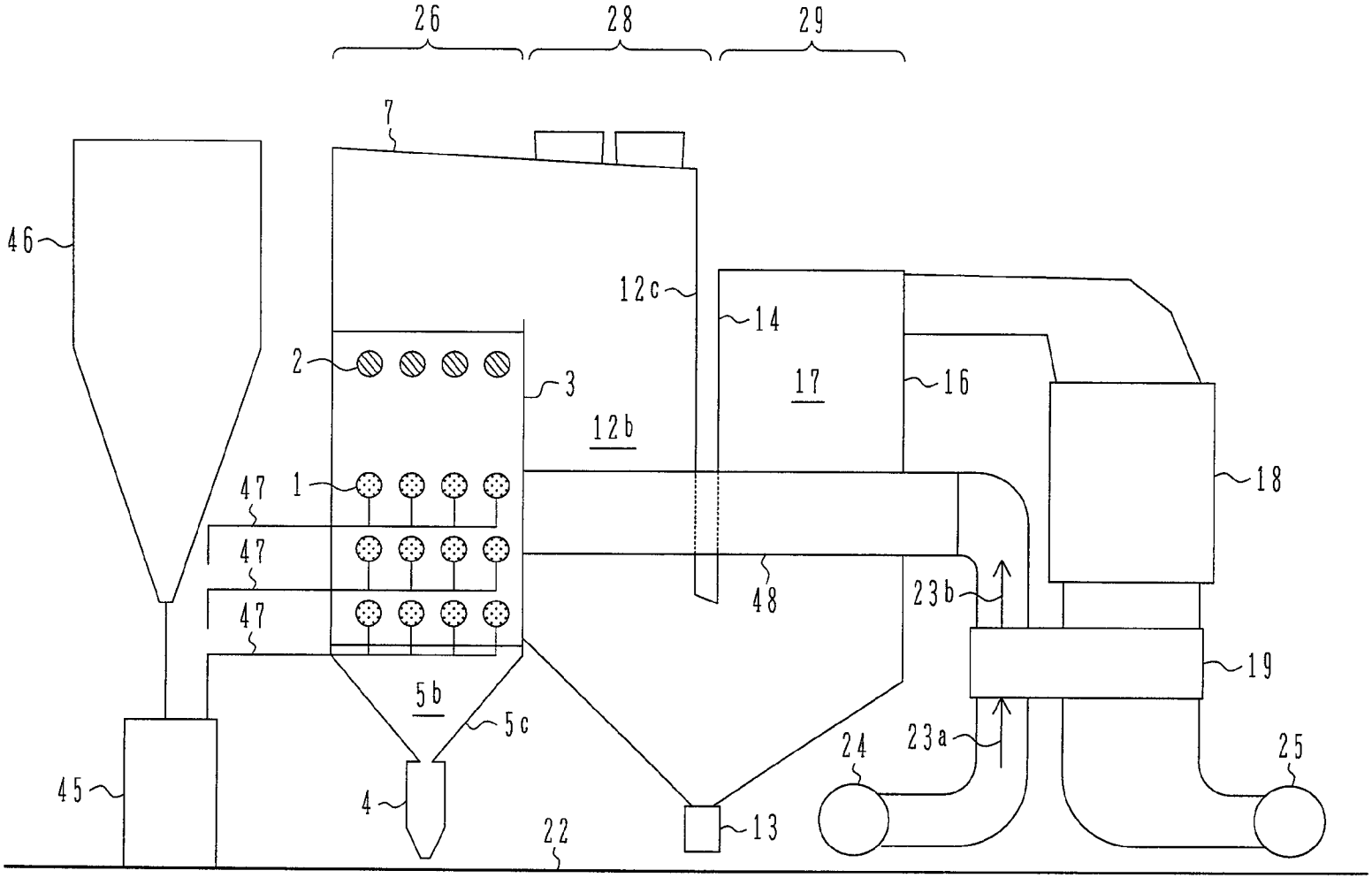
FIG. 16 is a side view illustrating a boiler according to an eleventh embodiment of the present invention.

FIG. 16 is a side view illustrating a boiler according to an eleventh embodiment of the present invention. In the eleventh embodiment, the burners are mounted on the right- and left-hand walls instead of the front and rear walls. The use of this configuration provides a simplified device layout because nothing is installed between the rear wall of the first furnace and the front wall of the second surface. Further, the boiler shown in FIG. 16 does not have the front wall of the second furnace. The front wall of the second furnace is substituted by the rear wall 5*c* of the first furnace. The use of this configuration reduces the amount of materials.

For the boiler shown in FIG. 16, a wind box duct 48 is installed to connect the air heater 19 to a wind box 3. The wind box duct 48 is mounted on the side walls of the second furnace 28 and heat recovery area 29. Since the wind box duct 48 is relatively long in a horizontal direction, it should be used as an inspection passage. Further, since the furnaces are not tall, devices are installed at a low place slightly above the ground. This makes it easy to inspect the devices.

The present embodiment assumes that a mill 45, which pulverizes coal, a coal silo 46, which stores coal, and fuel pipes 47, which convey coal, are also included. Placing the coal silo 46 inside a building provides increased ease of maintenance. When, in this instance, the coal silo height is substantially equal to the furnace height, construction can be accomplished with ease because the ceiling height of the building can be uniform.

Twelfth Embodiment

Figure 17:
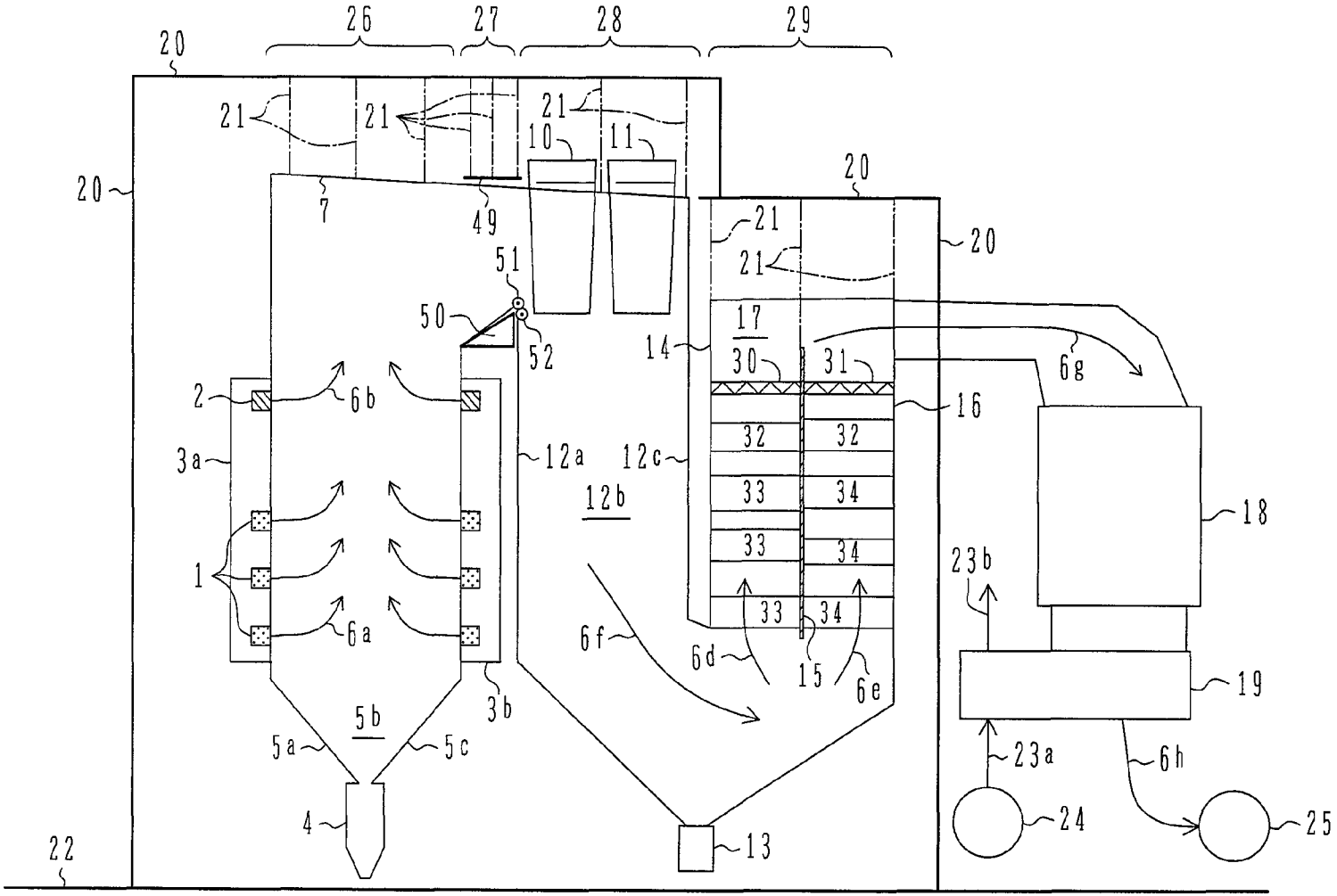
FIG. 17 is a side view illustrating a boiler according to a twelfth embodiment of the present invention.

FIG. 17 is a side view illustrating a boiler according to a twelfth embodiment of the present invention. The twelfth embodiment assumes that the furnace joint 27 has no screen tubes. If there are screen tubes, ash adhesion, wear, corrosion, or other problem is likely to occur. Therefore, the water wall tube provided for the rear wall 5*c* of the first furnace 26 is connected to a rear wall header 51 of the first furnace so as to discharge the steam to the outside. Further, the water wall tube provided for the front wall 12*a* of the second furnace is connected to a front wall header 52 of the second furnace so as to discharge the steam to the outside. A joint upper beam 49 is furnished to hang the rear wall 5*c* of the first furnace 26 and the front wall 12*a* of the second furnace 28. The joint upper beam 49 is connected to the iron frame 20. In addition, a joint lower beam 50 is also installed between the rear wall 5*c* of the first furnace and the front wall 12*a* of the second furnace to hang the rear wall 5*c* of the first furnace and the front wall 12*a* of the second furnace.

Figure 18:
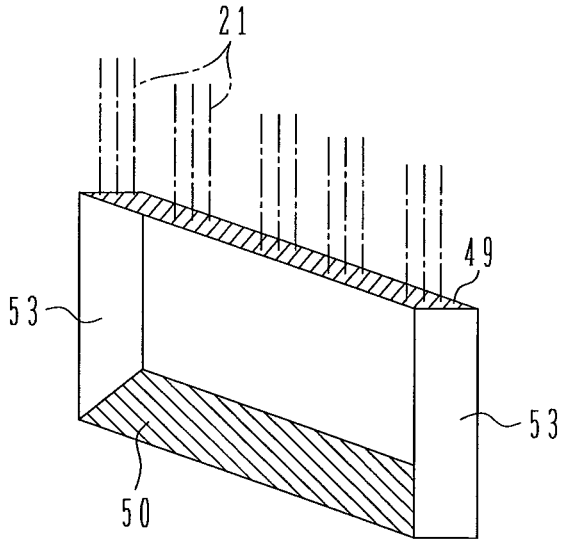
FIG. 18 shows a hanger structure according to the twelfth embodiment of the present invention.

FIG. 18 is an enlarged view illustrating the joint upper beam 49 and joint lower beam 50. A joint hanger structure 53 connects the joint lower beam 50 to the joint upper beam 49, thereby supporting the load on the rear wall 5*c* of the first furnace and the front wall 12*a* of the second furnace.

Figure 19B:
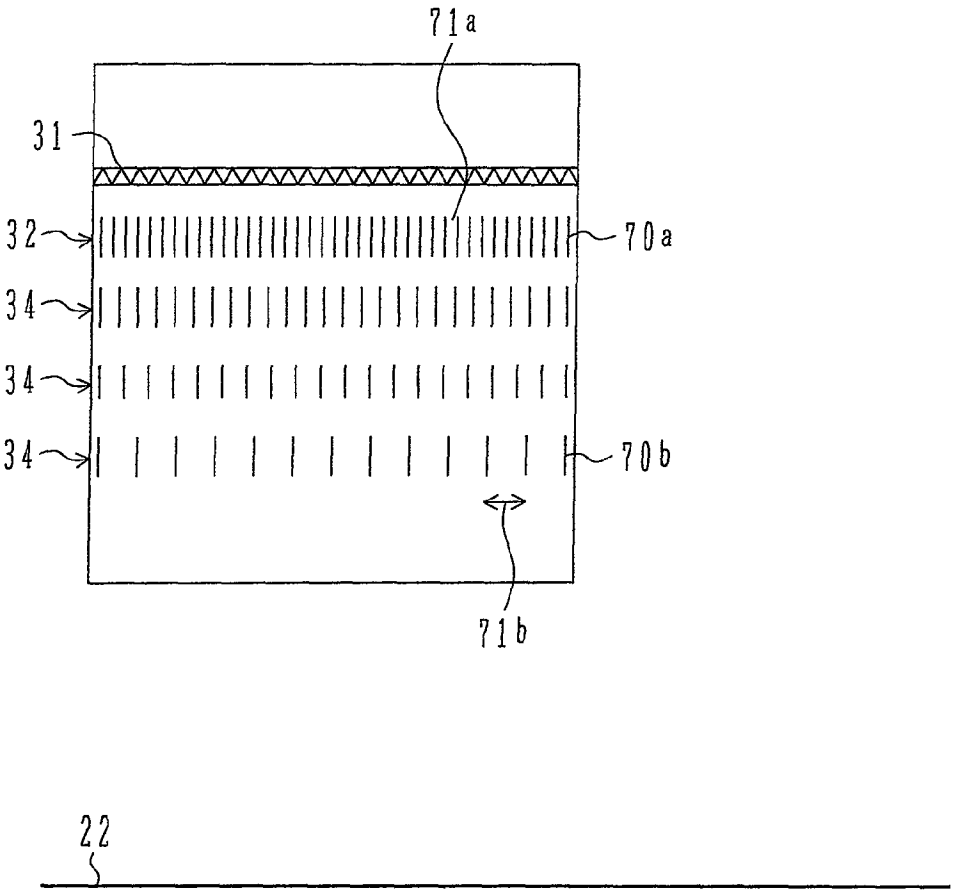
FIGS. 19A-19B are enlarged views illustrating heat recovery areas.
Figure 19A:
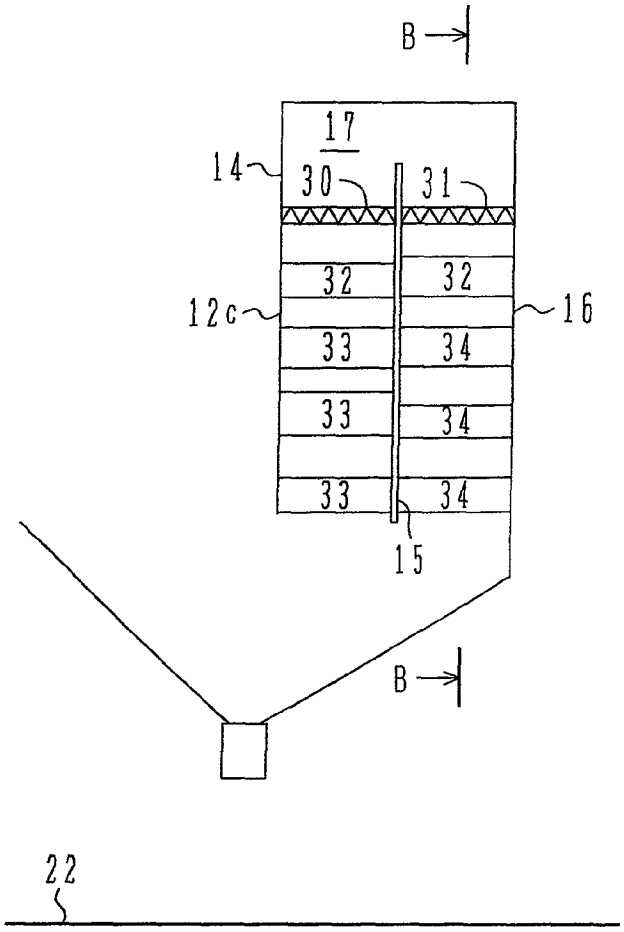

FIG. 19A is an enlarged view illustrating the heat recovery area 29, FIG. 19B is a view of the boiler taken along line B-B in FIG. 19A. Water or steam flows in the heat transfer tubes 70 (70*a*, 70*b*), whereas the combustion gases 6*d*, 6*e* flow outside the heat transfer tubes 70. The heat transfer tubes 70 heat the water or steam by effecting heat exchange between the combustion gases and the water or steam. The heat transfer tubes 70, which are positioned adjacent to each other, are placed at a predetermined interval 71 (71*a*, 71*b*) from each other so that the combustion gases 6*d*, 6*e* flow along the outer surfaces of the heat transfer tubes 70. This interval 71 means the distance between the outer surfaces of the heat transfer tubes 70.

A heat transfer tube 70*a* that is shown in the upper half of FIG. 19B is positioned downstream of the heat recovery area 29, whereas a heat transfer tube 70*b* that is shown in the lower half of FIG. 19B is positioned upstream of the heat recovery area 29. The combustion gases 6*d*, 6*e* that flow in the heat recovery area 29 flow upward in FIGS. 19A and 19B. The interval 71*b* of the heat transfer tube 70*b*, which is positioned on the upstream side, is longer than the interval 71*a* of the heat transfer tube 70*a*, which is positioned on the downstream side. Therefore, when the ash attached to the outer surface of the heat transfer tube 70*a* is removed with a soot blower, the ash readily passes through the interval 71*b* of the upstream heat transfer tube 70*b*, thereby making it possible to inhibit the combustion gas flow path from being blocked.

The description of the heat transfer tube interval, which has been set forth with reference to FIG. 19B, can also be applied to the heat transfer tubes of the economizer 32, reheater 33, and superheater 34. More specifically, the positional relationship between the heat transfer tubes for the economizer 32 conforms to the positional relationship depicted in FIG. 19B. The same also holds true for the reheater 33 and superheater 34.

Further, even when the economizer 32 positioned downstream of the heat recovery area 29 and the reheater 33 or superheater 34 positioned upstream of the heat recovery area 29 are compared, their heat transfer tubes conform to the positional relationship depicted in FIG. 19B.

The present invention is applicable to a boiler that shortens the construction period and reduces the amounts of NOx and CO.

What is claimed is:

1. A coal boiler comprising:

a first furnace in which a combustion gas generated by burning coal and air ascends;

a second furnace in which the combustion gas supplied from the first furnace flows downward, the second furnace including a staged combustion after-air port; and a heat recovery area in which the combustion gas supplied from the second furnace flows upward.

2. The coal boiler according to claim 1, wherein a heat exchanger mounted in the heat recovery area is made of tubes; and wherein the spacing interval between the tubes constituting the heat exchanger is longer on the upstream side than on the downstream side.

3. The coal boiler according to claim 2, further comprising:

a partition for dividing a combustion gas flow path in the heat recovery area into two.

4. The coal boiler according to claim 1, further comprising:

a superheater that is provided for a roof wall of the second furnace.

5. The coal boiler according to claim 1, further comprising:

a joint lower beam that is positioned between a rear wall of the first furnace and a front wall of the second furnace; and an iron frame to which the joint lower beam is connected.

6. The coal boiler according to claim 1, further comprising:

a water/steam flow path that allows steam or water flowing in a water wall tube constituting the first furnace to flow in a water wall tube constituting the second furnace, pass through a water-steam separator, and flow in a cage wall tube constituting the heat recovery area.

7. The coal boiler according to claim 6, further comprising:

a water/steam flow path that supplies steam discharged from the cage wall tube to a roof wall tube constituting the first furnace.

8. The coal boiler according to claim 1, further comprising:

a water/steam flow path that allows steam or water flowing in a water wall tube constituting the first furnace to flow in a cage wall tube constituting the heat recovery area, pass through a water-steam separator, and flow in a water wall tube constituting the second furnace.

9. The coal boiler according to claim 8, further comprising:

a water/steam flow path that supplies steam discharged from the cage wall tube to a roof wall constituting the first furnace.

10. The coal boiler according to claim 1, further comprising:

a water/steam flow path that supplies water to a water wall tube constituting the first furnace and a water wall tube constituting the second furnace, and allows the water to pass through a water-steam separator and flow in a cage wall tube provided for the heat recovery area.

11. The coal boiler according to claim 1, wherein the same member is used as a part of the second furnace and as a part of a cage wall of the heat recovery area.

12. The coal boiler according to claim 1, wherein the second furnace includes an ammonia or urea ejection port.

13. The coal boiler according to claim 1, further comprising:

a screen tube that is provided for a furnace joint connecting the first furnace to the second furnace;

wherein steam, air, or water is injected into the screen tube to remove ash.

14. The coal boiler according to claim 1, wherein a pendant structure is employed for the furnaces; wherein a ground-supported, free-standing structure is employed for a cage wall of the heat recovery area; and wherein a member for absorbing the thermal expansion of the cage wall is used to connect to the second furnace.

15. The coal boiler according to claim 1, wherein the gas temperature in the second furnace is high enough for fuel combustion but not high enough for thermal NOx generation.

16. The coal boiler according to claim 1, further comprising:

a flow path for supplying a flue gas to the second furnace from the downstream side of a heat exchanger provided for the heat recovery area.

17. The coal boiler according to claim 1, further comprising:

a structure for hanging a furnace joint provided between the first furnace and the second furnace.

18. A coal boiler combustion method comprising the steps of:

generating a combustion gas by burning coal and air ejected from a burner and allowing the generated combustion gas to ascend in a first furnace;

allowing the combustion gas supplied from the first furnace to descend in a second furnace;

supplying air to the second furnace through a staged combustion after-air port in the second furnace; and allowing the combustion gas supplied from the second furnace to ascend in a heat recovery area.

* * * * *